US007579537B2

(12) United States Patent
Lippert et al.

(10) Patent No.: US 7,579,537 B2
(45) Date of Patent: Aug. 25, 2009

(54) HOLDING DEVICE FOR A STRINGED INSTRUMENT

(75) Inventors: Helmut Lippert, Breitenbrunn (DE); Peter Reichert, Urspringen (DE)

(73) Assignee: Koenig & Meyer GmbH & Co. KG, Wertheim (DE)

( * ) Notice: Subject to any disclaimer, the term of this patent is extended or adjusted under 35 U.S.C. 154(b) by 0 days.

(21) Appl. No.: 12/030,428

(22) Filed: Feb. 13, 2008

(65) Prior Publication Data

US 2009/0151538 A1 Jun. 18, 2009

(30) Foreign Application Priority Data

Dec. 13, 2007 (DE) ..... 10 2007 060 103

(51) Int. Cl.
*G10D 3/00* (2006.01)

(52) U.S. Cl. ..... 84/327

(58) Field of Classification Search ..... 84/327, 84/329; 248/443; 206/314
See application file for complete search history.

(56) References Cited

U.S. PATENT DOCUMENTS

| | | | | |
|---|---|---|---|---|
| 5,973,244 | A * | 10/1999 | McCulloch | 84/327 |
| 6,127,612 | A * | 10/2000 | Yu | 84/327 |
| 6,513,768 | B1 | 2/2003 | Hsieh | |
| 2008/0168883 | A1 * | 7/2008 | Chen | 84/327 |

FOREIGN PATENT DOCUMENTS

| | | |
|---|---|---|
| DE | 195 07 681 | 7/2005 |
| EP | 1 494 207 | 1/2005 |

* cited by examiner

*Primary Examiner*—Kimberly R Lockett
(74) *Attorney, Agent, or Firm*—Greenblum & Bernstein, P.L.C.

(57) ABSTRACT

Holding device and method for holding an instrument. The holding device includes a housing, at least one holding arm having a mounting section coupled to a holding section through at least one offset lever section, and a resetting device structured and arranged to act eccentrically on the mounting section. The at least one holding arm is rotatable about a longitudinal axis of the mounting section.

18 Claims, 7 Drawing Sheets

HOLDING DEVICE FOR A STRINGED INSTRUMENT

CROSS-REFERENCE TO RELATED APPLICATIONS

The present application claims priority under 35 U.S.C. § 119 of German Patent Application No. 10 2007 060 103.6, filed on Dec. 13, 2007, the disclosure of which is expressly incorporated by reference herein in its entirety.

BACKGROUND OF THE INVENTION

1. Field of the Invention

The invention relates to a holding device for a stringed instrument, in particular for a guitar, having a housing with two holding arms arranged in a fork-shaped manner, the holding arms having a mounting section and a holding section, which are connected to one another via at least one offset lever section. At least one holding arm is rotatable about a longitudinal axis of the mounting section.

2. Discussion of Background Information

Holding devices of this type are used to securely hold often delicate stringed instruments. Stringed instruments are instruments having a body, a neck and a head. With a guitar, for example, the neck refers to that part of the guitar on which the strings of the guitar are gripped in order to change their effective length for producing the sound. The part on which clamping screws or the like are usually provided for tuning the guitar is called the head.

Stringed instruments are generally sensitive to mechanical stresses. Secure holding devices are therefore necessary for storing stringed instruments.

A guitar holder is known from DE 195 07 681 C2, which has a mounting housing to which two holding arms are attached, which project in the manner of a two-tined fork and form a support for a guitar head. In order to be able to adjust the spacing of the holding arms from one another to the width of the guitar neck, at least one holding arm is arranged on the mounting housing to be moveable in the direction of the other holding arm. To this end, the moveable holding arm is supported by one end part of an offset holding section on the mounting housing and can be pivoted about the end part with a circular motion.

With this construction, the position of the holding arms is held with the aid of friction-enhancing means. To feed in the guitar, it is then generally first necessary to enlarge the spacing between the holding arms by hand. However, subsequently, the instrument is held virtually automatically. The holding arms are moved towards one another by the weight of the instrument acting on the holding arms via the head of the instrument. A slight lifting of the instrument is sufficient to remove the instrument, the holding arms being slightly moved as well through the friction between the holding arms and the neck, so that the spacing between the holding arms is slightly enlarged again.

However, this spacing is generally so small that it is difficult to insert the instrument again. It is therefore first necessary to enlarge the spacing between the holding arms by hand again. Of course, the same also applies if another instrument having a neck with a larger width is to be inserted in the holding device. A user therefore generally needs a free hand in order to insert his instrument into the holding device.

A wall holder for a guitar is known from EP 1 494 207 A1, in which at least one holding arm is guided moveably in a groove and can be moved towards a second holding arm. At the same time, a resetting device that generates a translational return movement of the holding arm can be provided to move back the moveable holding arm. A shifting of the resetting device is not disclosed thereby.

SUMMARY OF THE INVENTION

The invention provides a holding device into which a stringed instrument can be easily inserted.

According to the invention, a holding device of the above-mentioned type, includes at least one holding arm having a resetting device that acts eccentrically on the mounting section.

A restoring moment is thus applied to the holding arm through the resetting device. However, this moment must not prevent a secure support of the instrument in the holding device. The resetting device is therefore adjusted such that the holding arms can be moved towards one another even with a light instrument, but the restoring force is still sufficient to enlarge the spacing of the holding arms from one another again after the removal of the instrument. Through this embodiment, the holding device exhibits a defined rest position, in which the holding arms are spaced far apart from one another. The holding device automatically adopts this position again after an instrument has been removed. There is therefore no difficulty in inserting an instrument, even if the neck of the new instrument is wider than that of the instrument that was previously held in the holding device. This results in simplified handling.

The mounting sections preferably extend into the housing, the resetting device being arranged in the housing. The resetting device is thus protected by the housing, e.g., from soiling. At the same time a harmonious visual impression is produced, which is not impaired by the resetting device, since it is covered by the housing. The mounting sections can thereby be mounted in the housing, e.g., by a snap ring. A complex mounting is not generally necessary. The only important factor is for the mounting sections to be pivotable. A possible rotational angle can thereby be limited, e.g., by stops that are arranged in the housing.

The resetting device is preferably embodied as a spring. This represents a relatively cost-effective solution, which is very low-maintenance at the same time. Since the resetting device acts eccentrically on the mounting section, the spring can be embodied as a simple compression spring or tension spring. However, it is also possible to embody the spring as a torsion spring. The dimensions of the spring are thereby defined with respect to the necessary restoring force.

Preferably, only one resetting device, which acts eccentrically on both mounting sections, is provided. Then it is no longer necessary for the resetting device also to be mounted in the housing. At the same time, it is rendered possible for both of the holding arms to be moved at the same time, the force generated by the resetting device being distributed uniformly onto the two holding arms. Depending on the head shape, a symmetrical or asymmetrical movement of the holding arms takes place. The number of necessary components is thereby minimized, so that production is cost-effective.

An opening is advantageously arranged in the mounting section perpendicular to the rotational axis, in which opening a pin is arranged, the resetting device being mounted on one end of the pin. A reliable and simple mounting of the resetting device is thus possible. The opening can be embodied, e.g., as a bore. The pin can be held inside the opening, e.g., by a nut and snap ring. It is also possible to provide the opening with an internal thread, into which the pin is screwed, which must then have a corresponding external thread. The length of the pin, measured from the rotational axis to the point at which the resetting device is mounted, is then the lever arm via which the restoring moment is applied. In a particularly simple embodiment, the pins can also be pressed and/or glued into the opening.

It is particularly preferred thereby for the pins to be arranged parallel to one another in a rest position of the holding arms. An identical holding moment is thus exerted on both holding arms in the rest position.

An offset extension is preferably arranged on one end of the holding sections in each case, the extensions being rotatable towards one another. Through the motion of the holding arms towards one another caused by the weight of the instrument, the head of which rests on the holding arms, the offset extensions, which are located at the ends of the two holding sections of the holding arms, are therefore also pivoted towards one another. The instrument is then reliably prevented from being removed or from falling out by the extensions. A secure support of the instrument is thus ensured.

The holding arms preferably have a coating. This coating should be made from a slip-resistant material, such as, e.g., PP-EPDM. The coating can then be used as a further protection against the instrument slipping out and, because of its elasticity, can also be used for carefully holding the instrument. The coating can thereby be embodied as an injection molded part which is injected onto the holding arms.

It is particularly preferred thereby for the extension to be embodied in one piece with the coating. The extensions can thus be produced in a very cost-effective manner. Since the instrument is already held by the holding arms, it is not necessary either for the extensions to be able to generate a large holding force. In fact, it is advantageous for them to be flexible since this reduces the risk of injury.

In a preferred embodiment, the housing is embodied in a closed manner, one top side and/or one underside having a cover. The resetting device arranged inside the housing is thereby completely enclosed by the housing, and is therefore housed in a very protected manner. A cover arranged on the top side and/or underside thereby still renders access to the resetting device possible. The installation of the resetting device is thereby also simplified.

The housing is preferably connected to a mounting geometry in a rotatable manner. The mounting geometry is used to mount the holding device, e.g., on a stand or on a wall. Once the housing is connected to the mounting geometry in a rotatable manner, the housing can be rotated in a space-saving manner such that the holding arms run parallel to the wall or to the stand. If the holding device is connected to a movable stand, e.g., via the mounting geometry, the rotation of the housing renders possible a space-saving transport.

The present invention is directed to a holding device for an instrument. The holding device includes a housing, at least one holding arm having a mounting section coupled to a holding section through at least one offset lever section, and a resetting device structured and arranged to act eccentrically on the mounting section. The at least one holding arm is rotatable about a longitudinal axis of the mounting section.

According to a feature of the invention, the at least one holding arm can include at least two holding arms. Further, each of the at least two holding arms may include a mounting section coupled to a holding section through at least one offset lever section, and each of the at least two holding arms can be rotatable about the longitudinal axis of its mounting section. The resetting device can be a single element structured and arranged to act eccentrically on both mounting sections, or the resetting device can be at least two elements structured and arranged to act eccentrically on respective mounting sections. Further still, offset extensions can be located on ends of each of the holding sections. The offset extensions may be structured and arranged to be rotatable in opposite directions. Moreover, the at least two holding arms can be arranged in a fork-shaped manner.

In accordance with another feature of the present invention, the instrument can be a stringed instrument, and the stringed instrument may be a guitar.

According to still another feature of the instant invention, the mounting section can extend into the housing and the resetting device may be located in the housing.

According to another feature, the resetting device can include a spring.

Moreover, the holding device can further include a pin extending from the mounting section. The pin may be located within an opening in the mounting section arranged perpendicular to the longitudinal axis, and the resetting device is coupled to the pin.

In accordance with a further feature of the instant invention, the at least one holding arm may include at least two holding arms, and each of the at least two holding arms can include a pin extending from its mounting section. The pins of each of the at least two holding arms may be arranged parallel to one another in a rest position of the holding arms.

Further, the holding arms can have a coating. Still further, an offset extension located on an end of the holding section opposite the mounting section can be formed in one piece with the coating.

According to another feature, the housing can include a top side cover and an underside cover to form a closed housing.

In accordance with still yet another feature of the present invention, the housing can be rotatably connectable to a mounting geometry.

The invention is directed to a method for holding an instrument. The method includes imparting, under weight of the instrument, opposing rotational forces on mounting sections of at least two holding arms. In this manner, extensions at ends of the at least two holding arms opposite the mounting sections rotate in opposing directions to hold the instrument, and a spacing between the ends of the at least two holding arms opposite the mounting sections is reduced.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
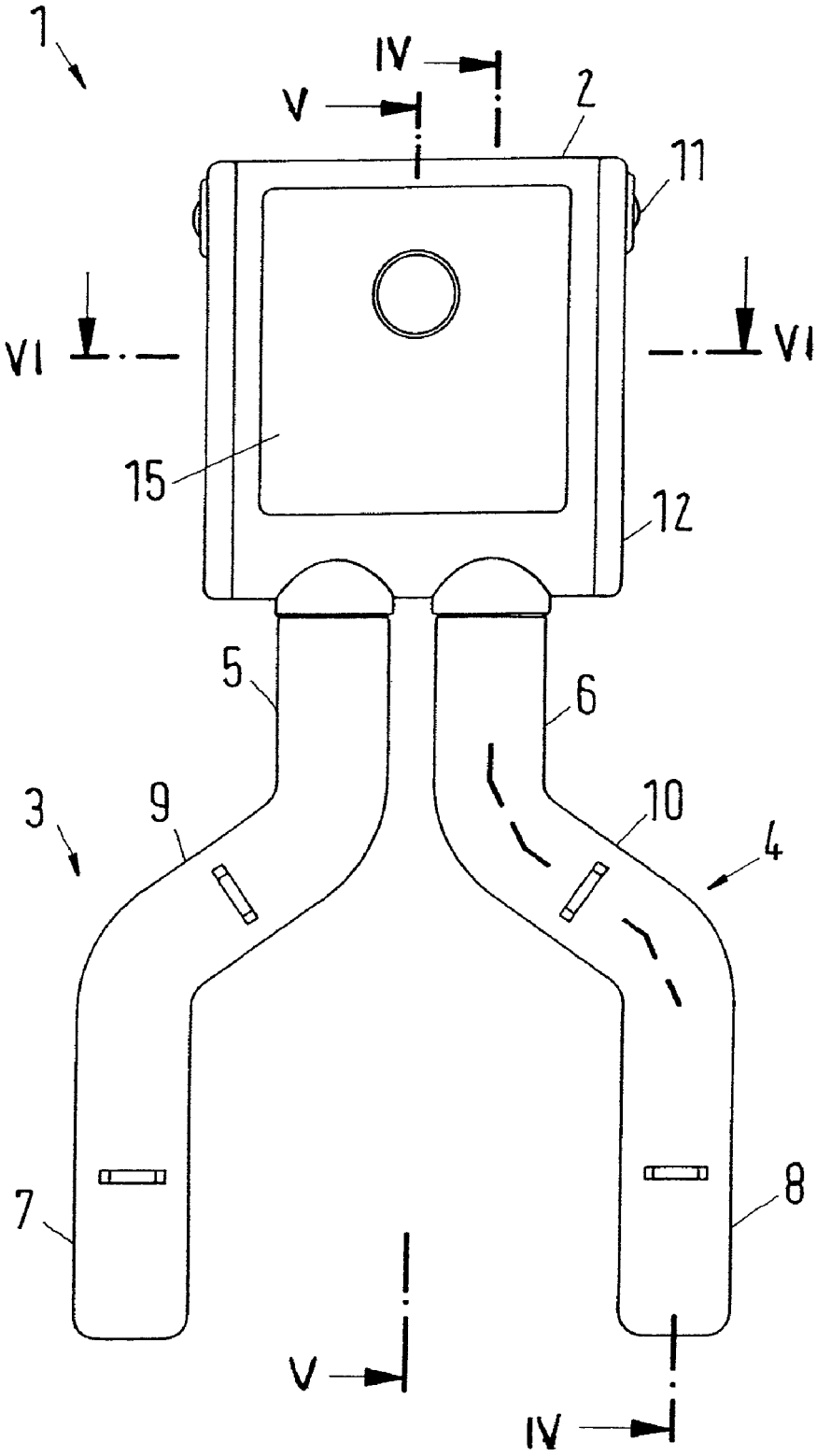
FIG. 1 illustrates a plan view of a holding device of a first embodiment.

FIG. 1 shows a holding device 1 for a stringed instrument, which device can be attached to a stand or support. Holding device 1 has a housing 2 on which two holding arms 3, 4 are mounted in a rotatable manner. Holding arms 3, 4 thereby project, e.g., in the manner of a two-tined fork. The holding arms each have a mounting section 5, 6 and a holding section 7, 8, which are connected to one another via an offset lever section 9, 10. Holding section 7, 8 is used to support a head of a stringed instrument, such as, e.g., a guitar. The housing 2 is connected in a rotatable manner via an axis 11 to a mounting geometry.

Holding arms 3, 4 can be rotated about their mounting sections 5, 6, such that holding sections 7, 8 thereby perform a circular motion. A spacing between the holding sections 7, 8 thereby changes with a pivoting or rotary motion of holding arms 3, 4, as shown in FIG. 2 by the alternative positions of extensions 13, 14 (which are located at the ends of holding sections 7, 8, respectively, remote from housing 2).

Figure 2:
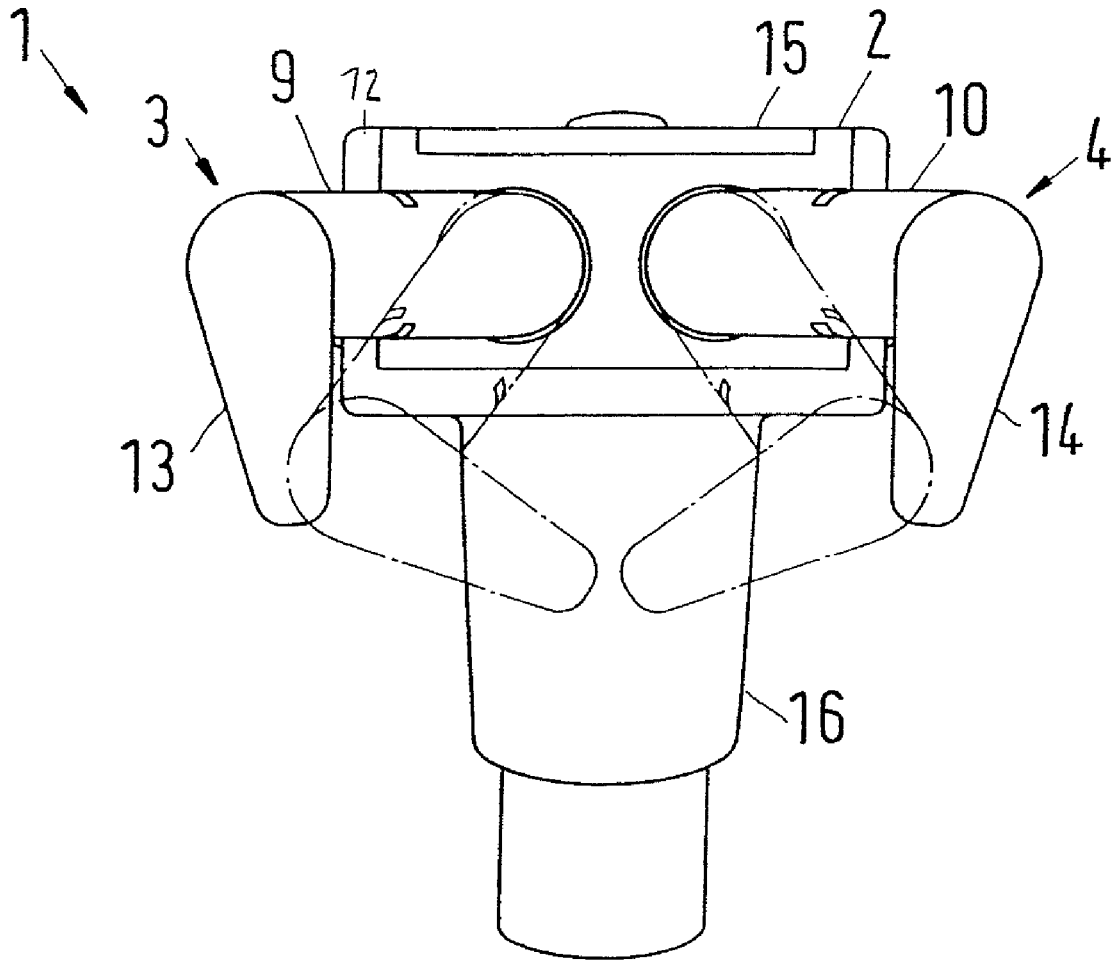
FIG. 2 illustrates a side view of the holding device.

In the exemplary embodiment shown in FIG. 2, holding arms 3, 4 each have an extension 13, 14. A rest position of holding arms 3, 4, shown in solid lines, can be adopted when no instrument is being held. A holding position of holding arms 3, 4, is shown in broken lines. Through the rotation or pivoting of holding arms 3, 4, extensions 13, 14 can be arranged virtually parallel to one another in the rest position, whereas, in the holding position, extension 13, 14 can be arranged to point towards one another in order to prevent removal of the instrument.

The housing 2 is provided with a cover 15, which closes the top side of the housing 2. The mounting geometry 12 has a receptacle 16 for a cylindrical body. This can be, e.g., a support.

In another preferred embodiment, which is shown in FIGS. 7 through 11, holding device 1 can be embodied or formed as a wall holder. In such an embodiment, housing 2 can be embodied or formed in one piece with an open back 31. When mounted to a wall, open back 31 may be arranged to face the wall so that housing 2 can be closed by the wall in the installed state. In the simplest case, the mounting geometry can be embodied as bores 32, through which, e.g., screws can be inserted in order to mount holding device 1 on the wall.

Figure 3:
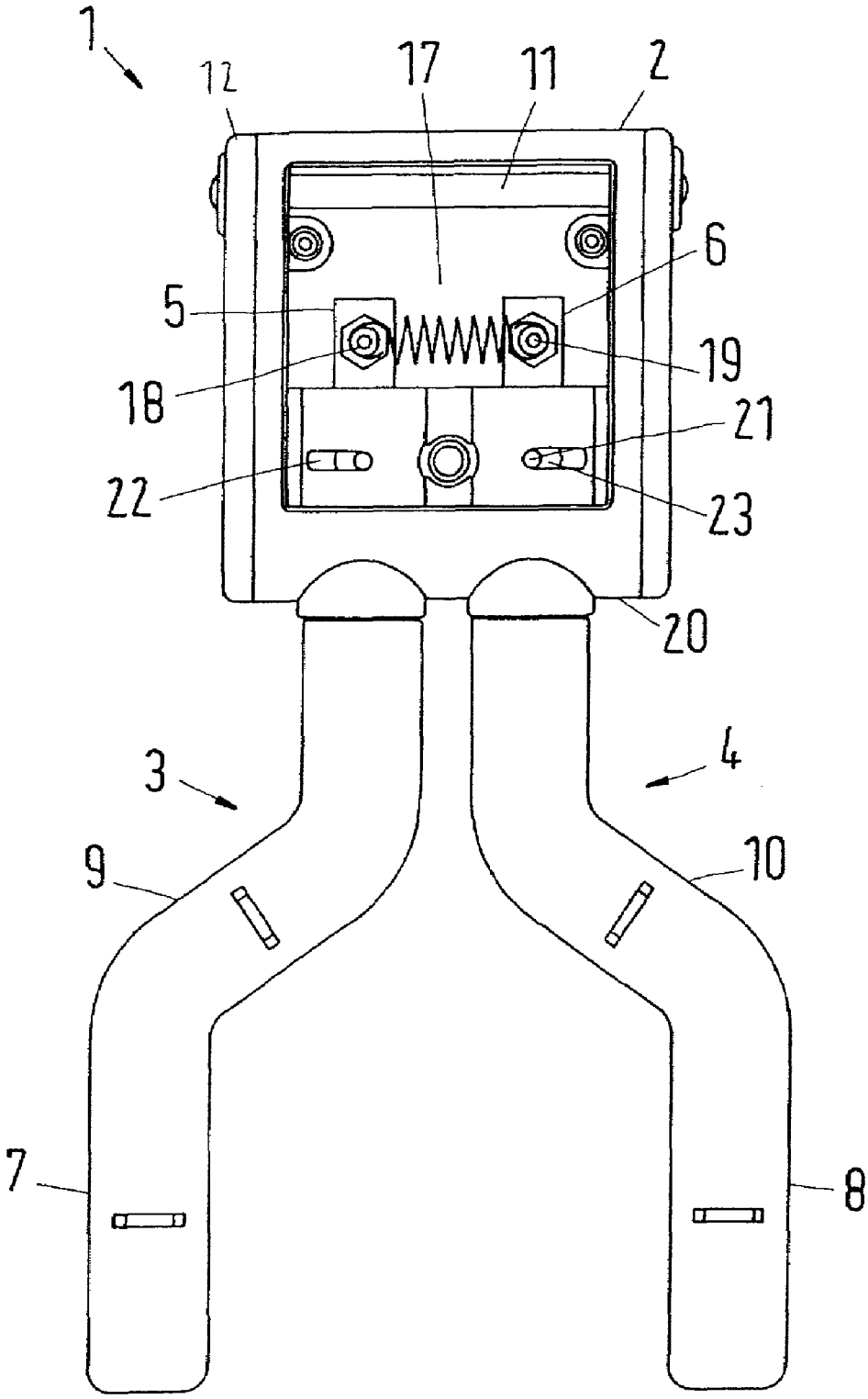
FIG. 3 illustrates a plan view of the holding device with the cover removed.

FIG. 3 shows holding device 1 according to FIG. 1 with cover 15 removed. From this exemplary illustration it can be discerned that extensions or portions of mounting sections 5, 6 extend into housing 2 and may be connected to one another via a resetting device 17 acting eccentrically on mounting sections 5, 6. Resetting device 17 may be embodied as or formed by a spring attachable to pins 18, 19, which can be arranged on mounting sections 5, 6. After an instrument has been removed from holding device 1, resetting device 17 returns holding arms 3, 4 to the rest position.

A front face 20 of housing 2, through which mounting sections 5, 6 of holding arms 3, 4 can be guided, has a relatively large wall thickness so that a secure support of holding arms 3, 4 is ensured. Holding arms 3, 4 may be held in the axial direction inside front face 20 with the aid of pins 21, which are guided in grooves 22, 23. A pivoting of the holding arms 3, 4 is thereby permitted over a predetermined angle (or limited to the predetermined angle) defined by the length of grooves 22, 23. Lateral stops can also be provided to limit the possible further rotational angle of holding arms 3, 4. In this manner, the position of holding arms 3, 4 in the rest position can be defined.

Figure 4:
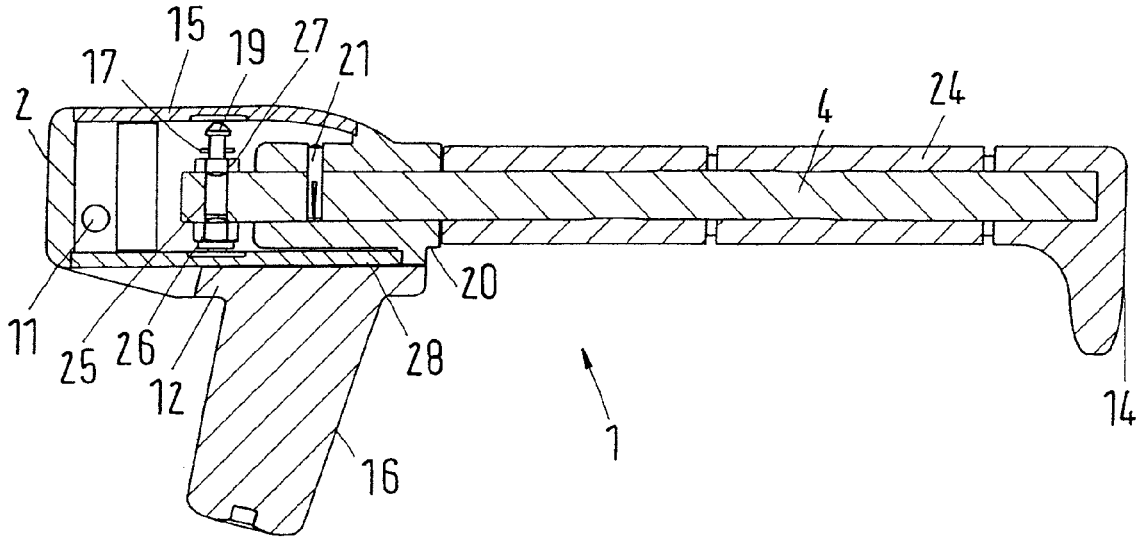
FIG. 4 illustrates a longitudinal section of the holding device.

FIG. 4 shows a sectional view of the holding device according to FIG. 1, the cutting plane in FIG. 1 being labeled IV-IV. Holding arm 4 is provided with a coating 24, which is made from a slip-resistant elastic material. This coating may be embodied or formed, e.g., as an injection molded part, injected onto holding arm 4. Holding arm 4 can have a core that can be embodied as a bent part, in particular as a wire bent part. The extension 14 may be embodied or formed in one piece with coating 24. Holding arm 3 can be embodied or formed in a corresponding manner.

Pin 19 may be guided through an opening 25 in mounting section 6 of holding arm 4 and held with a nut 26 interacting with a hexagon drive 27. While hexagon drive 27 can be embodied or formed as a nut that can be screwed onto pin 19, hexagon drive 27 can also be embodied or formed in one piece with pin 19. In this alternative, pin 19 can be made from, e.g., a hexagonal material and further shaped outside of hexagon drive 27, e.g., by rotational machining. Of course, other methods for forming, structuring and/or mounting pin 19 are also conceivable.

Housing 2 is connected to the mounting geometry 12 in a pivoted manner via axis 11. It is thereby possible to pivot housing 2 together with holding arms 3, 4 about almost 270°. According to the representation in FIG. 4, this pivoting can be carried out in a counter-clockwise direction. Through the pivoting it is possible, e.g., during transport, to bring holding arms 3, 4 into a position in which their longitudinal direction runs parallel to receptacle 16 to achieve a particularly space-saving transport configuration.

Figure 5:
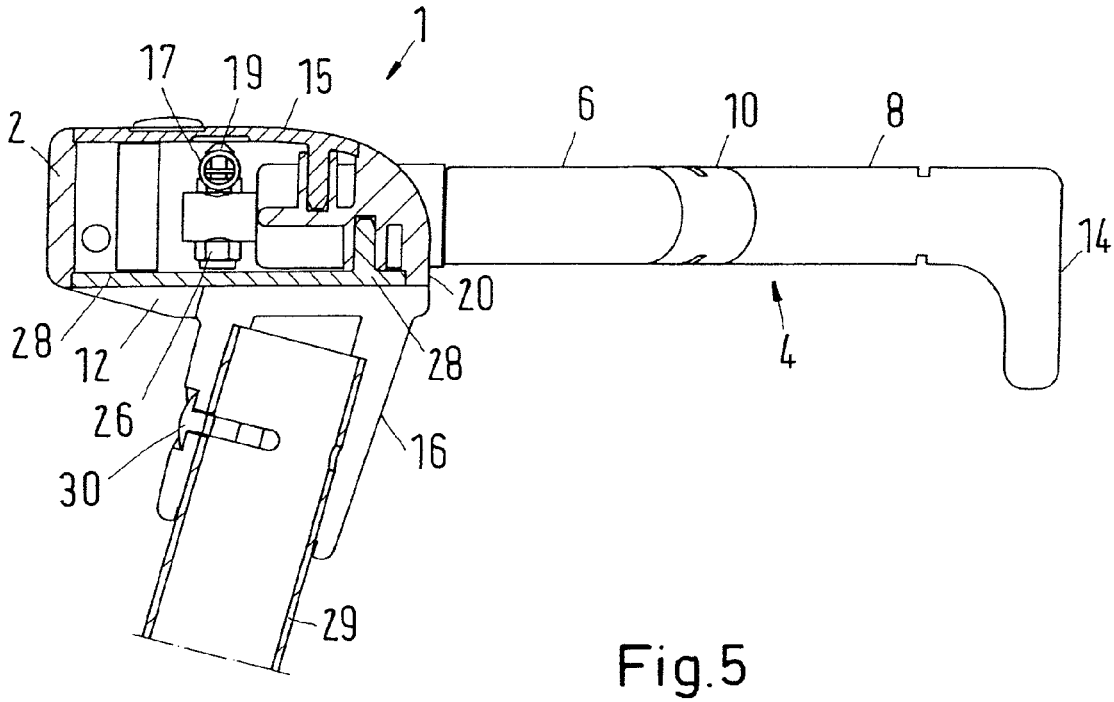
FIG. 5 illustrates a further longitudinal section of the holding device.

FIG. 5 shows another sectional view of the holding device 1, the cutting plane in FIG. 1 being labeled V-V. It is discernible that the large wall thickness of the front face 20 serves not only to guide the holding arms 3, 4, but also to attach the cover 15 and a further cover 28, which is arranged on an underside of the housing 2, in a positive manner by a press fitting. Cylinder pipe 29 may be accommodated in receptacle 16 and attached by, e.g., a split rivet 30. Moreover, instead of a split rivet, e.g., a screw can also be used or an undercut can be provided on receptacle 16. Still further, cylinder pipe 29 can be, e.g., part of a support.

Figure 6:
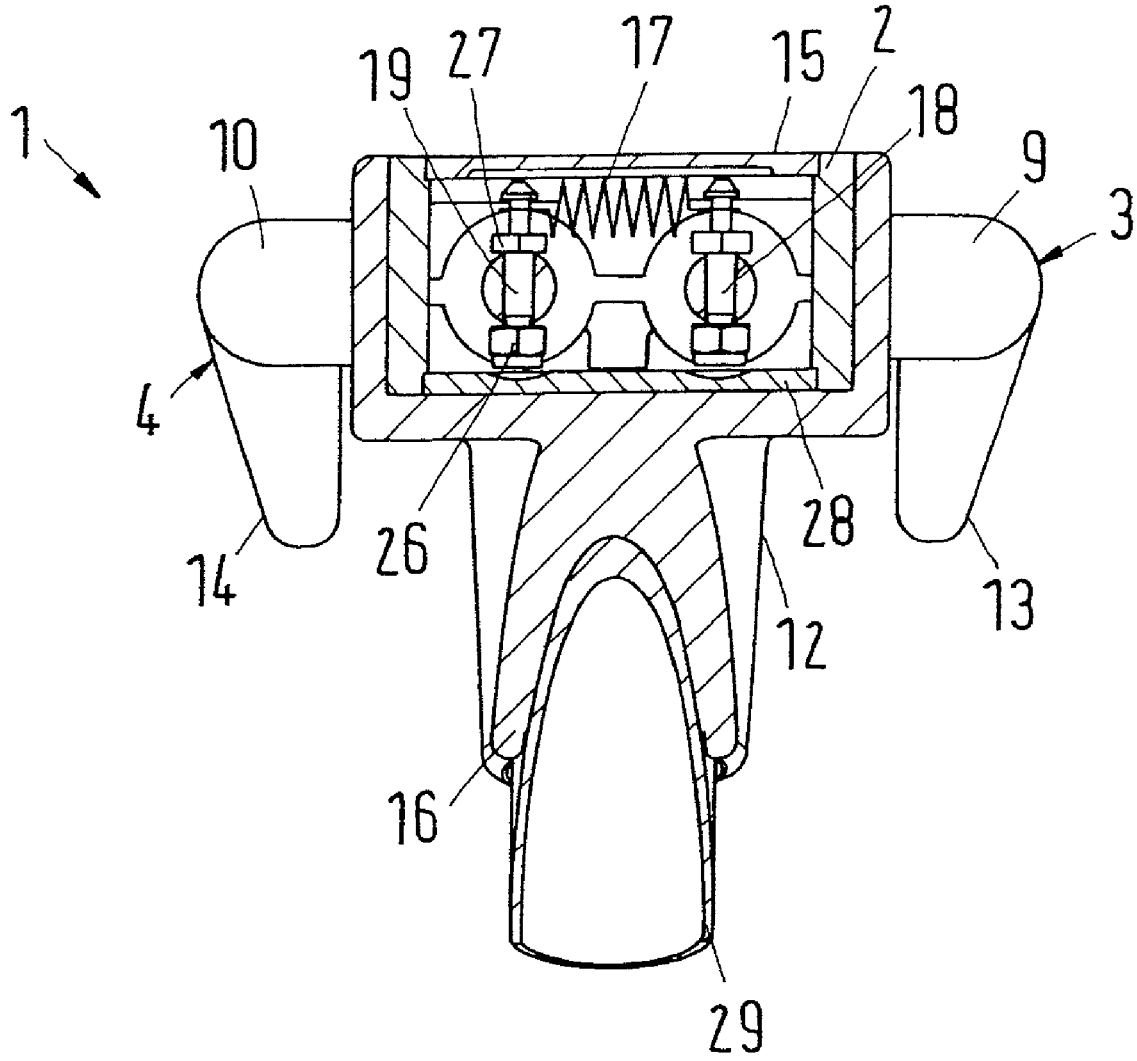
FIG. 6 illustrates a sectional view of the holding device.

FIG. 6 shows the holding device 1 in cross section, the cutting plane in FIG. 1 being labeled VI-VI. Holding device 1 is thereby shown in a rest position, such that pins 18, 19 are arranged to extend essentially parallel to one another.

In the above-discussed exemplary embodiments only a single common resetting device 17 has been illustrated for connection to both holding arms 3, 4. However, it is also conceivable to provide each holding arm 3, 4 with its own resetting device. Moreover, while such resetting devices can be embodied or formed as tension springs, it is understood that these resetting devices can also be formed in other manners or structures without departing from the spirit and scope of the invention. Further, notwithstanding the structure of the single or multiple resetting devices, it may be advantageous to arrange the resetting device(s) to act eccentrically on mounting sections 5, 6 of holding arms 3, 4, as is shown in FIG. 6 for a single resetting device 17 in order to apply a restoring moment to holding arms 3, 4.

With holding device 1 according to the invention, holding arms 3, 4 may be mounted on housing 2 such that a driving force acting on holding arms 3, 4 can be generated with the force of gravity, e.g., by inserting an instrument into holding device 1, and converted into a rotational or pivoting motion of holding arms 3, 4 that reduces the spacing between holding sections 7, 8 of holding arms 3, 4. When the driving force ceases to act, i.e., after the instrument has been removed, holding arms 3, 4 can be returned to their rest position with the aid of resetting device 17 to enable or allow easy insertion of the same or another instrument.

Holding device 1 according to the invention can be used not only for guitars, but also for other stringed instruments such as, e.g., a banjo, a ukulele, a balalaika, or also for bowed instruments, such as violins, violas or cellos, and any other instrument or devices having a head wider than its neck.

In the exemplary embodiments according to FIGS. 1 through 6, holding device 1 is provided with a mounting geometry for mounting holding device 1 on a stand or support. With an embodiment of the holding device as a wall holder, as shown in FIGS. 7 through 11, the mounting geometry can be embodied or formed in a much simpler manner. A particularly simple embodiment results from embodying the mounting geometry in one piece with the housing, wherein a pivoting of housing 2 with respect to the mounting geometry can be omitted.

Figure 7:
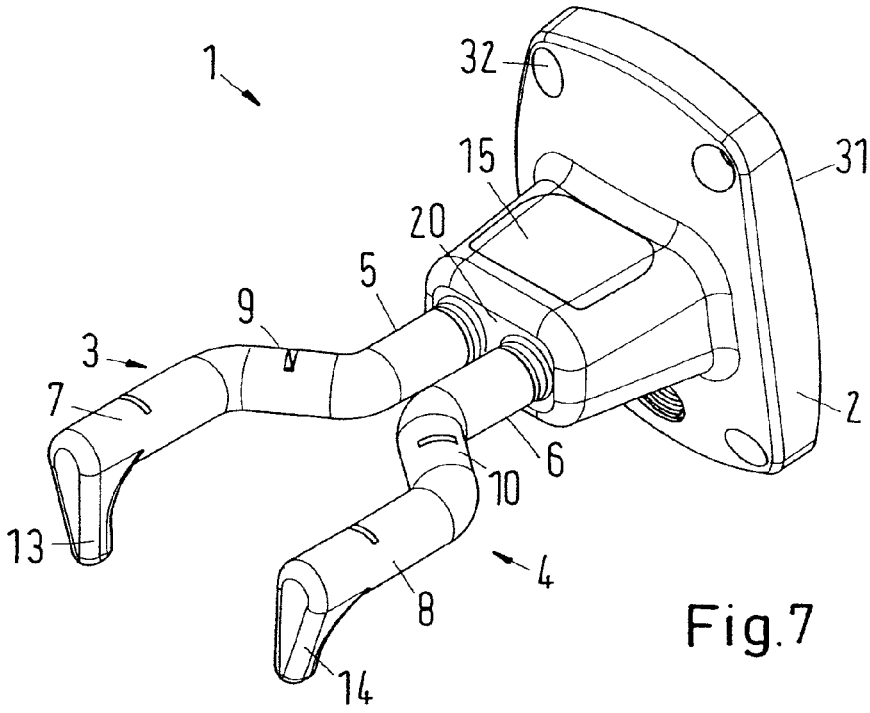
FIG. 7 illustrates a three-dimensional view of a holding device of a second embodiment.

With the preferred exemplary embodiment according to FIG. 7, the mounting geometry is embodied or formed as bores 32. These are arranged in a flange-like extension of housing 2. While four bores 32 are illustrated in the exemplary figures, it is understood that the number of bores 32 is virtually arbitrary. Due to the extension of housing 2, holding device 1 can have a large mounting surface on a wall (not shown). Further, housing 2 may be provided with an open rear 31 on the side provided to bear against the wall. While it is also possible to embody this rear in a likewise closed manner, the cost of such added materials can be saved with an open rear 31 arrangement. Otherwise, the embodiment of holding device 1 according to FIG. 7 can be embodied or formed in a manner consistent with the exemplary embodiments of FIGS. 1 through 6. Further, for ease of explanation, identical parts are therefore given the same reference numbers.

Figure 8:
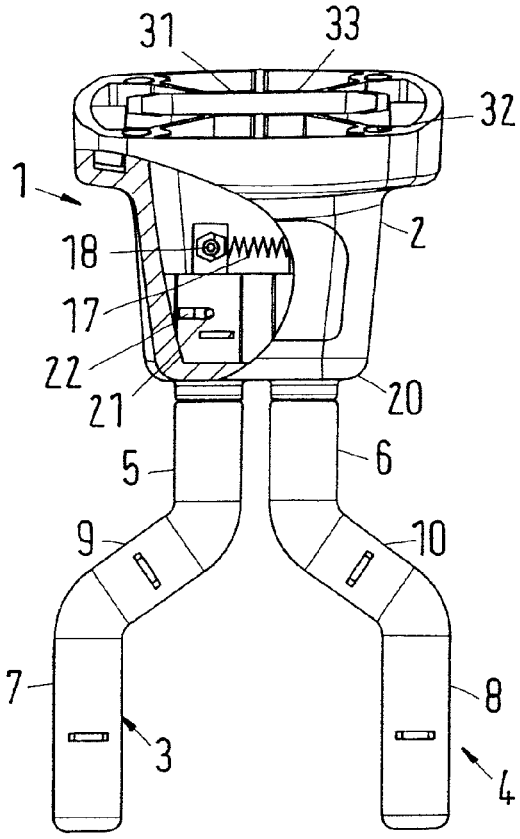
FIG. 8 illustrates a partially sectional view of the holding device according to FIG. 7.

FIG. 8 shows that strengthening ribs 33 may be arranged in housing 2 in order to embody or form housing 2 in a light but nevertheless sufficiently stable manner.

Figure 9:
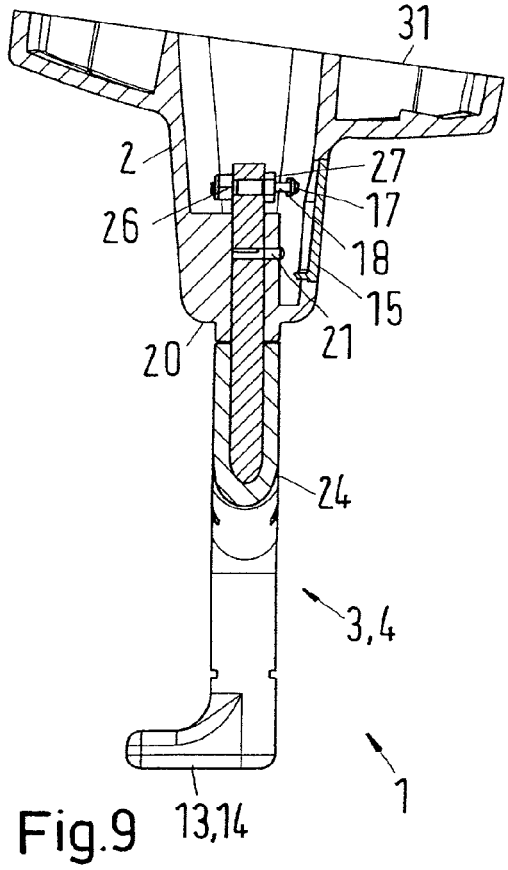
FIG. 9 illustrates a longitudinal section of the holding device.

FIG. 9 shows that lower cover 28 (in FIGS. 4-6) can be omitted in the exemplary embodiment of holding device 1 as a wall holder. Through open rear 31, resetting device 17 can be mounted or coupled to mounting sections 5, 6 of holding arms 3, 4 in a simple manner. If necessary, cover 15 can also be omitted, so that the entire housing 2 can be produced from one piece, e.g., as an injection molded part.

Figure 10:
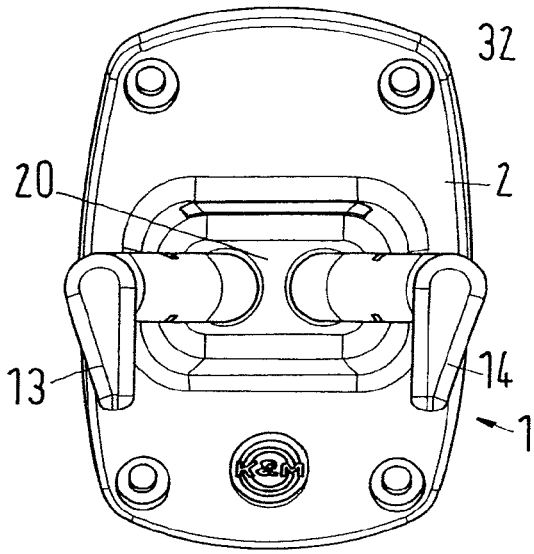

FIG. 10 shows the holding device 1 in a rest position, i.e., in the position adopted by holding arms 3, 4 when they are not loaded.

Figure 11:
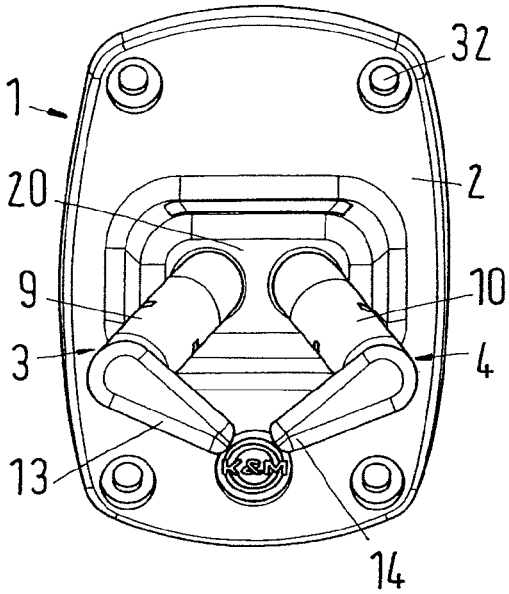
FIG. 10 illustrates a side view of the holding device in the rest position and FIG. 11 illustrates a side view of the holding device in the loaded position.

FIG. 11 shows a position of holding arms 3, 4 when holding device 1 is in use, i.e., the position adopted under load. It can be seen that, as offset levers 9, 10 are pivoted under the load of the instrument the spacing between the holding sections 7, 8 of holding arms 3, 4 is reduced. At the same time, extensions 13, 14 pivot towards one another to securely hold the instrument neck in such a manner that it is virtually impossible for the instrument to fall out.

Holding device 1 according to the invention for stringed instruments can be adapted to different functions by simple adjustment of the mounting geometry and/or of housing 2. As was shown, it is thus easily possible to embody or form a holding device 1 as a wall holder or as a holder for a stand. If holding device 1 according to the invention is used in connection with a stand, additional holding elements on the stand generally used for supporting the body may possibly be omitted, since holding device 1 of the invention already ensures the instrument is held securely. Stands structured in a particularly simple manner can thereby be used, no individual adjustment to different instrument sizes being necessary.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A holding device for an instrument, comprising:

a housing;

at least one holding arm having a mounting section coupled to a holding section through at least one offset lever section; and a resetting device structured and arranged to act eccentrically on the mounting section, wherein the at least one holding arm is rotatable about a longitudinal axis of the mounting section, wherein the at least one holding arm comprises at least two holding arms, and wherein each of the at least two holding arms comprise a mounting section coupled to a holding section through at least one offset lever section, and each of the at least two holding arms is rotatable about the longitudinal axis of its mounting section.

2. The holding device in accordance with claim 1, wherein the resetting device is a single element structured and arranged to act eccentrically on both mounting sections.

3. The holding device in accordance with claim 1, wherein the resetting device comprises at least two elements structured and arranged to act eccentrically on respective mounting sections.

4. The holding device in accordance with claim 1, further comprising offset extensions located on ends of each of the holding sections, wherein the offset extensions are structured and arranged to be rotatable in opposite directions.

5. The holding device in accordance with claim 1, wherein the at least two holding arms are arranged in a fork-shaped manner.

6. The holding device in accordance with claim 1, wherein the instrument is a stringed instrument.

7. The holding device in accordance with claim 6, wherein the stringed instrument is a guitar.

8. The holding device in accordance with claim 1, wherein the mounting section extends into the housing and the resetting device is located in the housing.

9. The holding device in accordance with claim 1, wherein the resetting device comprises a spring.

10. The holding device in accordance with claim 1, further comprising a pin extending from the mounting section.

11. The holding device in accordance with claim 10, wherein the pin is located within an opening in the mounting section arranged perpendicular to the longitudinal axis.

12. The holding device in accordance with claim 10, wherein the resetting device is coupled to the pin.

13. The holding device in accordance with claim 1, wherein the at least one holding arm comprises at least two holding arms, and each of the at least two holding arms comprise a pin extending from its mounting section, and wherein the pins of each of the at least two holding arms are arranged parallel to one another in a rest position of the holding arms.

14. The holding device in accordance with claim 1, wherein the holding arms have a coating.

15. The holding device in accordance with claim 14, further comprising an offset extension located on an end of the holding section opposite the mounting section, wherein the extension is formed in one piece with the coating.

16. The holding device in accordance with claim 1, wherein the housing comprises a top side cover and an underside cover to form a closed housing.

17. The holding device in accordance with claim 1, wherein the housing is rotatably connectable to a mounting geometry.

18. A method for holding an instrument, comprising:

imparting, under weight of the instrument, opposing rotational forces on mounting sections of at least two holding arms, whereby extensions at ends of the at least two holding arms opposite the mounting sections rotate in opposing directions to hold the instrument, and whereby a spacing between the ends of the at least two holding arms opposite the mounting sections is reduced.

* * * * *